United States Patent [19]

Devon

[11] 4,375,394

[45] Mar. 1, 1983

[54] ELECTROLYTIC PROCESS FOR THE PREPARATION OF ETHYLENE GLYCOL AND GLYCERINE

[75] Inventor: Thomas J. Devon, Longview, Tex.

[73] Assignee: Eastman Kodak Company, Rochester, N.Y.

[21] Appl. No.: 356,992

[22] Filed: Mar. 11, 1982

[51] Int. Cl.[3] ..... C25B 3/00

[52] U.S. Cl. ..... 204/79; 204/72; 204/78; 568/862

[58] Field of Search ..... 204/72, 78, 79; 568/862

[56] References Cited

U.S. PATENT DOCUMENTS

| | | | |
|---|---|---|---|
| 1,937,273 | 11/1933 | Helwig | 204/79 |
| 2,419,515 | 4/1947 | Wolk | 204/79 |
| 4,270,992 | 6/1981 | Saito | 204/59 R |

*Primary Examiner*—John F. Niebling

*Attorney, Agent, or Firm*—David E. Cotey; Daniel B. Reece, III

[57] ABSTRACT

The present invention provides a process for the preparation of ethylene glycol and glycerine by a selective electrolysis that cleaves the carbon-carbon bonds of carbohydrate-derived polyols into two- and three-carbon units. The intermediate products can then be reduced to the desired ethylene glycol and glycerine products using standard reduction technology. The electrolysis is conducted in the presence of an electrolysis medium which contains manganese.

6 Claims, No Drawings

ELECTROLYTIC PROCESS FOR THE PREPARATION OF ETHYLENE GLYCOL AND GLYCERINE

BACKGROUND OF THE INVENTION

Ethylene glycol is currently made by the silver-catalyzed oxidation of ethylene to ethylene oxide, which is reacted with water to give the glycol in overall yields approaching 75% based on ethylene. Other ethylene-based processes have been used and proposed for the preparation of ethylene glycol. Such processes include the well-known halohydrin process and chloride electrochemical oxidation.

The use of synthesis gas as an alternative feedstock for the preparation of ethylene glycol has been investigated. Such a process requires pressures in excess of 16,000 psig and very high loadings of expensive rhodium catalyst (3000 ppm) to obtain modest production rates. The process produces an undesirable mixture of methanol, ethanol, propylene glycol, and traces of glycerine in addition to ethylene glycol.

Glycerine may be obtained in limited quantity by the saponification of fats. Larger quantities of glycerine can be obtained using propylene-based chemistry, such as the hydrolysis of epichlorohydrin and the epoxidation and subsequent hydrolysis of allyl alcohol.

The cleavage of vicinal diols by chemical means is well known in the art. Periodic acid cleavage has been used to unselectively degrade carbohydrate molecules to one-carbon fragments. Likewise, potassium permanganate and potassium persulfate together with silver have been used to cleave vicinal diols. The former reagent is generally not selective for producing aldehyde cleavage fragments, frequently oxidizing the primary alcohol groups to carboxylic acids. The electrochemical interactions of carbohydrate-derived polyols have been investigated sporadically in the past. The prior art teaches that glucose can be oxidized to gluconic acid by electrolysis in the presence of bromine. Also, the prior art teaches that mannitol, a carbohydrate-derived polyol, is decomposed to a mixture of formaldehyde and carboxylic acids.

Unlike the prior art discussed above, the present invention provides a method for producing ethylene glycol and glycerine from polyols which may be derived from carbohydrates. The inventive process involves selectively electrolyzing the polyols to two- and three-carbon fragments which can then be reduced to ethylene glycol and glycerine. The inventive process is advantageous in that it allows the preparation of key raw materials totally from renewable resources. The feed to the process comprises carbohydrate-derived polyols which can be obtained by the acidic or enzymatic hydrolysis of cellulose or starch or from naturally occurring monosaccharides. It is contempated that the present invention is especially suitable for use in a solar-hydrogen-electric economy.

SUMMARY OF THE INVENTION

The present invention provides a process for the production of ethylene glycol and glycerine which comprises (a) electrolyzing a carbohydrate-derived polyol in the presence of an electrolyte containing manganese, and (b) reducing the intermediate products to ethylene glycol and glycerine.

DETAILED DESCRIPTION OF THE INVENTION

The present invention relates to the preparation of ethylene glycol and glycerine by a selective electrolysis that cleaves the carbon-carbon bonds of carbohydrate-derived polyols into two- and three-carbon units that can be reduced to the desired ethylene glycol and glycerine products using standard reduction technology.

The polyols which may be subjected to the inventive electrolysis process typically are five- and six-carbon molecules carrying a multiplicity of hydroxy groups. In general, each carbon atom of these compounds bears a hydroxy group. These compounds are "carbohydrate-derived" in the sense that these compounds may be, and preferably are, obtained by well-known processes from cellulose, starch, or naturally occurring monosaccharides. For example, the polyols which are utilized in the process of the present invention are readily available by the hydrogenation of simple hexose sugar. The large-scale acidic or enzymatic hydrolysis of cellulose or starch into mixtures of hexose and pentose monosaccharides is well known. These monosaccharides can be hydrogenated economically under mild conditions to produce crude mixtures of five- and six-carbon polyols which can be used as the feedstock for the process of the present invention. While the polyols which are useful in the process of the present invention may have carbohydrates as their source, the process is applicable to the polyols regardless of actual source.

Those polyols which are naturally derived from sugars are preferred for use in the process of the present invention. Specific polyols which are preferred for use in the process of the present invention include sorbitol, mannitol, D-(−)-fructose, xylitol, erythritol, and mixtures thereof. Especially preferred polyols include xylitol, sorbitol, and mannitol. The stereochemistry of the polyols does not appear to affect the product distribution obtained from the electrolysis reaction of the present invention.

According to the process of the present invention, polyols such as those mentioned above can be selectively electrolyzed to two- and three-carbon fragments by including in the electrolysis medium small amounts of magnanese. The manganese may be introduced into the electrolysis medium in any form which is soluble in the specific medium. Any manganese salt which is soluble in the electrolysis medium and which does not poison the hydrogenation catalyst downstream may be used. The manganese is preferably introduced in the form of an organic or inorganic salt, e.g., an Mn(II) salt. Preferred manganese salts are the manganese carboxylates which are soluble in water. While the use of other manganese salts will be apparent to one of ordinary skill in the art, an especially preferred salt is $Mn(OAc)_2$.

The concentration of manganese utilized in the process of the present invention is not especially critical. Good yields of ethylene glycol and glycerine were obtained at manganese concentrations as high as 500 ppm manganese or as low as 50 ppm manganese, based upon the total weight of the electrolysis medium.

The solvent which is used in the electrolysis medium can be any good conductor which is capable of dissolving the polyols which are fed to the process of the present invention. Water is a preferred solvent because of its high conductivity, its low cost, and its ability to dissolve the carbohydrate-derived polyols.

The electrolyte which is used in the electrolysis medium can be any compound which is a good conductor, which does not interfere with the formation of the active anode surface, and which enables the manganese to remain in solution. Various sulfates, borofluorides, and other well-known electrolytes have been used favorably in the process of the present invention. Specific examples of suitable electrolytes include $Na_2SO_4$, $NaHSO_4$, $MgSO_4$, $Al_2(SO_4)_3$, $NaBF_4$, etc.

It has been observed that the pH of the electrolysis medium is a factor influencing the yield of ethylene glycol and glycerine which can be obtained by the process of the present invention. Very high pH ranges (e.g., above about 11) appear to lower the concentration of soluble manganese because of precipitation of manganous hydroxide. Very low pH ranges (e.g., below about 1.5) appear to affect the selectivity of the process. Therefore, it is preferred to operate the process of the present invention in the relatively mildly acidic to relatively neutral regions of the pH range. Thus, acceptable pH's can be found within the range of about 1.5 to 9. The optimal pH for a particular electrolysis system will become apparent to one of ordinary skill in the art.

The electrolysis is commonly conducted at elevated temperature. Temperatures within the range of about 50°–95° C. (e.g., about 80°–90° C.) have been determined to be especially suitable. However, the particular temperature employed is not critical to the process of the present invention.

The reaction which takes place during the process of the present invention occurs at the anode. Therefore, the anode must be of a material which supports the electrolysis reaction. While other materials may also be used, it has been observed that graphite and platinum are especially suitable anode materials. The cathode may be made from any material which is stable under the conditions of the reaction. A preferred electrode system utilizes concentric platinum anode and platinum cathode. Examples of other suitable anodes include graphite rods.

While the electrical current density is not an especially critical parameter in the process of the present invention, energy considerations will indicate to the skilled artisan the optimal current density to be employed in a particular process. Low current densities are desirable due to the fact that lower voltage drops, with a proportional savings in electrical energy, are obtained across a given electrochemical cell. However, the savings in electrical energy are tempered with the requirement for larger cell sizes in order to obtain the desired throughput of converted polyol. In the process of the present invention, it has been observed that very low current densities reduce still further the energy requirements for converting polyol to glycol and glycerine and increase the selectivity to the formation of $C_2$ fragments. However, at such low current densities the percent of polyol which was converted by the process decreased for equivalent amounts of electrical charge.

The reactions which are believed to be involved in the process of the present invention are illustrated by the following equations:

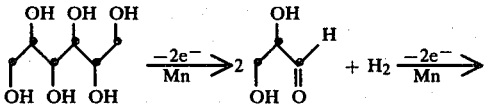

-continued

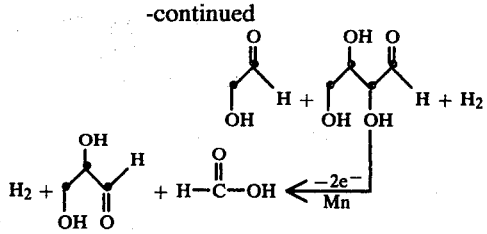

Thus, the six-carbon polyol can be converted to two moles of glyceraldehyde and hydrogen or to a mixture of 2-hydroxyacetaldehyde, hydrogen, and the corresponding four-carbon hydroxyaldehyde. The four-carbon fragment then reacts further to cleave out a mixture of glyceraldehyde, formic acid, and hydrogen. Corresponding reaction schemes for starting materials comprising four- and five-carbon starting materials can likewise be devised. Such reaction schemes graphically demonstrate the extraordinary selectivity to two- and three-carbon fragments which is provided by the electrolysis process of the present invention.

The hydroxyaldehyde fragments which are obtained by the initial reaction is the process of the present invention can readily be converted to the desired ethylene glycol and glycerine products by the well-known catalytic reduction with hydrogen at elevated temperatures and pressures, as illustrated below:

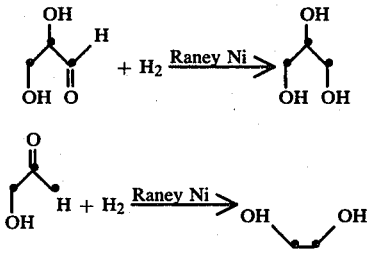

The catalytic hydrogenation can be conducted under such conditions as are well known in the prior art. Merely by way of example and not is any way limiting the scope of the invention thereby, it can be mentioned that it has been favorable to conduct the aforementioned catalytic hydrogenation in conventional equipment, such as a stainless steel rocking autoclave, at elevated pressures on the order of 1,000 psig and elevated temperatures in the vicinity of 150° C. However, any reaction conditions which are suitable for use in a typical catalytic hydrogenation process can be used in the process of the present invention.

Certain of the by-products of the reaction, such as glycolic acid, are not capable of being reduced by Raney nickel. For such compounds, other well-known reduction processes may be used. In the case of glycolic acid, the acid can be converted to the ester, which can then be reduced to ethylene glycol under conditions of elevated temperature and pressure using a copper chromite catalyst.

The process of the present invention provides unique selectivity to the production of two- and three-carbon fragments from polyols such as hexose and pentose derivatives. This selectivity is due to the presence of small quantities of manganese during electrolysis. While I do not wish to be bound by theoretical considerations, it has been observed that the successful operation of the inventive process is dependent upon the presence of a faint dark film on the surface of the anode. The film was observed to be very reactive and to disappear within a minute of current shut-down when the anode remained in contact with the hot electrolysis solution. The film was determined to contain manganese oxide in the $Mn^{+2}$ oxidation state. This dark film of manganese oxide appears to be responsible for the unique ability to cleave polyols at the internal carbon-carbon bonds. Furthermore, the cleavage reaction appears to be an electrochemical process taking place at the electrode surface. Thus, attempts to duplicate the cleavage reaction by merely refluxing an aqueous solution of sorbitol with activated manganese dioxide failed to produce any carbon-carbon bond cleavage.

The invention will be further illustrated by the following Examples although it will be understood that these Examples are included merely for purposes of illustration and are not intended to limit the scope of the invention.

EXAMPLE 1

Anhydrous sodium sulfate (1.0 g; 0.00704 mole) and manganous acetate tetrahydrate (0.010 g; 0.000041 mole) were dissolved in 15 mL of distilled water in a 50 mL beaker. This solution was warmed to 60° C. and sorbitol monohydrate (18.2 g; 0.091 mole) was dissolved. The resulting solution was made up to 40 mL total volume. Two concentric Pt wire mesh electrodes were placed in the solution. The outer electrode was 38 $cm^2$ in surface area and was the anode (oxidizing electrode). The inner electrode (cathode) had a surface area of 23 $cm^2$.

The current flow was set at 3.00 amperes (current density of 0.079 amps/$cm^2$; total charge of 2.20 Faradays per mole of polyol), and the solution was electrolyzed for 107 minutes. Distilled water was added so as to maintain the solution volume at 40 mL. The temperature was maintained at 80°-90° C., and the average voltage drop across the cell during the run was 8.3 volts.

The product solution was diluted to approximately 200 mL with distilled water. Raney nickel powder was washed three times with demineralized water in order to remove caustic salts. The product solution and 2.0 grams of the washed Raney nickel were charged into a 300 mL stainless steel rocking autoclave. The autoclave was pressurized with hydrogen to 1000 psig at room temperature and heated with rocking to 150° C. The pressure was maintained at 1000 psig for two hours at 150° C. The autoclave was cooled to room temperature and vented to atmospheric pressure. The contents were filtered and washed through filter paper to remove the nickel catalyst. The pale green filtrate was stripped on a rotary evaporator at 13 mm Hg at up to ~80° C. in order to remove water. The warm syrup was then held at 4 mm Hg pressure for 15 minutes to pull out any remaining free water. A net weight of 12.77 g of pale green syrup was obtained.

0.01 g of the product mixture was placed in a dry glass vial. Dry reagent grade pyridine (2 mL) and 1.5 mL of Regisil® (bis-trimethylsilyl trifluoroacetamide) were introduced with a syringe. The mixture was allowed to stand overnight, during which time the polyol dissolved in the reagent mixture to form the trimethylsilyl derivatives. The mixture was analyzed using a Hewlett-Packard Model 5730A chromatograph with thermoconductivity detectors. The column was a 2% OV-101/80-100 mesh chromasorb G column (6'×⅛" Ni). The program used was a 4-minute hold at 100° C. and a 16°/minute program up to 200° C. and a 16-minute hold at 200°. Peak retention times found for the TMS derivatives were: ethylene glycol, 1.88 minutes sharp peak; glycolic acid, 2.92 minutes sharp; glycerine, 6.60 minutes sharp; erythritol, 9.11 minutes sharp; xylitol, 10.93 minutes with slight broadening; mannitol and sorbitol, very broad peaks spread over 12-16 minutes.

The weight ratio of the polyol compounds in a given mixture corresponds closely to the area ratios of the TMS derivatives. The weight of each polyol in the reduction mixture was calculated from the weight of crude polyol after taking into account the weight of supporting electrolyte. The results are tabulated below.

TABLE I

| Ethylene Glycol (g) | Glycolic Acid (g) | Glycerol (g) | C-4 Fragment (g) | C-5 Fragment (g) | % Polyol Converted | Power Usage KWhr/mole Polyol Converted |
|---|---|---|---|---|---|---|
| 2.00 | 0.00 | 2.65 | 0.62 | trace | 55 | 0.90 |

This example illustrates the great selectivity to C-2 and C-3 fragments which is provided by the process of the present invention. This selectivity is believed to be due to the small amounts of manganese which are incorporated into the electrolysis medium.

EXAMPLE 2

Example 1 was repeated except that 0.1 mole of mannitol was used as the polyol. The polyol was electrolyzed by 0.2 Faraday of electric charge. The results are tabulated below.

TABLE II

| Ethylene Glycol (g) | Glycolic Acid (g) | Glycerine (g) | C-4 Fragment (g) | C-5 Fragment (g) | % Polyol Converted | Power Usage KWhr/mole Polyol Converted |
|---|---|---|---|---|---|---|
| 1.86 | 0.11 | 2.12 | 0.66 | 0.56 | 55 | 0.70 |

Again, the selectivity of the process to two- and three-carbon fragments is demonstrated.

COMPARATIVE EXAMPLES 1-12

These Comparative Examples illustrate the uniqueness of manganese as a promoter for the process of the present invention. These Comparative Examples were conducted either in the absence of promoter or in the presence of metal salts other than manganese. Comparative Examples 1-10 employed 0.1 mole of sorbitol as the polyol, while Comparative Examples 11 and 12 utilized 0.1 mole of mannitol. Comparative Examples 1-9 and 12 employed an electrical charge of 2.00 Faradays/mole, Comparative Example 10 used 1.00 Faraday/mole, and Comparative Example 11 used 2.2 Faradays/mole. In all other respects, the Comparative Examples followed the procedure outlined in Example 1. The results are tabulated below.

TABLE III

| Comparative Example No. | Promoter | Ethylene Glycol (g) | Glycolic Acid (g) | Glycerine (g) | C-4 Fragment (g) | C-5 Fragment (g) | % Polyol Converted | Power Usage KWhr/mole Polyol Converted |
|---|---|---|---|---|---|---|---|---|
| 1 | None | 0.41 | 0.24 | 0.72 | 1.03 | 1.45 | 26 | 1.77 |
| 2 | $Fe(OAc)_2OH$ | 0.47 | 0.16 | 0.86 | 1.44 | 1.79 | 31 | 1.56 |
| 3 | $Cr(OAc)_3$ | 0.42 | 0.28 | 0.77 | 1.31 | 1.81 | 29 | 1.43 |
| 4 | $Ce(OAc)_x$ | 0.33 | 0.37 | 0.63 | 1.27 | 2.08 | 27 | 1.67 |
| 5 | $VO(OAc)_2$ | 0.50 | 0.26 | 0.54 | 1.14 | 1.34 | 32 | 1.42 |
| 6 | $Tl(NO_3)_3$ | 0.62 | 0.14 | 0.87 | 1.54 | 1.07 | 30 | 1.54 |
| 7 | $Co(OAc)_2$ | 0.71 | 0.24 | 0.80 | 1.44 | 1.41 | 35 | 1.23 |
| 8 | $Na_2MoO_4$ | 0.20 | 0.23 | 0.46 | 0.88 | 1.96 | 26 | 1.66 |
| 9 | $NaReO_4$ | 0.35 | 0.31 | 0.63 | 1.36 | 2.25 | 27 | 1.61 |
| 10 | None | 0.28 | 0.0 | 0.46 | 0.83 | 1.43 | 11 | 1.95 |
| 11 | $AgNO_3$ | trace | 0.16 | 0.55 | 0.85 | 1.66 | 25 | 1.62 |
| 12 | None | 0.0 | trace | 0.32 | 0.56 | 0.79 | 37 | 1.13 |

It is apparent from the results tabulated above that in the absence of manganese the process loses its selectivity to two- and three-carbon fragments. In addition, in the Comparative Examples illustrated above, the percent polyol conversion is depressed and the power usage is greatly increased as compared to the values given for Examples 1 and 2.

EXAMPLES 3 AND 4

These Examples illustrate the effect of the concentration of manganese acetate on the process of the present invention. In Example 3, the manganese concentration was 0.005 molar, and in Example 4, the manganese concentration was 0.01 molar. Example 3 used 0.1 mole of sorbitol as the polyol, 1.0 mole per liter of sodium sulphate as the electrolyte, and 2.00 Faradays per mole electrical charge. In all other respects, the procedures of Examples 3 and 4 were the same as that of Example 1, which utilized a manganese concentration of 0.001 molar and the results of which are again given in Table IV for convenience.

TABLE IV

| Example No. | Mn Conc. (Molar) | Ethylene Glycol (g) | Glycolic Acid (g) | Glycerine (g) | C-4 Fragment (g) | C-5 Fragment (g) | % Polyol Converted | Power Usage KWhr/mole Polyol Converted |
|---|---|---|---|---|---|---|---|---|
| 1 | 0.001 (55 ppm) | 2.00 | 0.00 | 2.65 | 0.62 | trace | 55 | 0.90 |
| 3 | 0.005 | 1.34 | 0.00 | 2.33 | 0.48 | 0.00 | 38 | 0.57 |
| 4 | 0.010 (550 ppm) | 0.96 | 0.10 | 1.74 | 0.95 | 0.00 | 32 | 1.38 |

It can be seen from a review of Table IV that the yield to the desired two- and three-carbon fragments was favored at the lower manganese concentration.

EXAMPLES 5 AND 6

These Examples illustrate the effect of current density on the process of the present invention. In each of Examples 5 and 6, the total charge, in term of Faradays per mole, was 2.00, and 0.1 mole of sorbitol was employed. In Example 5, the current density was 0.132 amps/cm$^2$, whereas in Example 6, the current density was 0.0053 amps/cm$^2$. In all other respects, Examples 5 and 6 reproduced the procedure of Example 1. The results are given below in Table V. The results of Example 1 are also given for purposes of comparison.

TABLE V

| Example No. | Current Density (Amps/cm$^2$) | Ethylene Glycol (g) | Glycolic Acid (g) | Glycerine (g) | C-4 Fragment (g) | C-5 Fragment (g) | % Polyol Converted | Power Usage KWhr/mole Polyol Converted |
|---|---|---|---|---|---|---|---|---|
| 5 | 0.132 | 1.73 | 0.20 | 2.72 | 0.41 | 0.00 | 40 | 1.08 |
| 1 | 0.079 | 2.00 | 0.00 | 2.65 | 0.62 | trace | 55 | 0.90 |
| 6 | 0.0053 | 1.24 | 0.00 | 0.71 | 0.15 | 0.00 | 23 | 0.43 |

A review of Table V indicates that the current density employed does not greatly affect the selectivity of the process. However, the polyol conversion is somewhat depressed at low current density.

EXAMPLE 7 AND 8

These Examples illustrate the use of other electrolytes besides sodium sulfate in the process of the present invention. In Example 7, 0.1 mole of sorbitol was electrolyzed in the presence of 0.16 mole per liter of $NaBF_4$; in Example 8, 0.1 mole of sorbitol was electrolyzed in the presence of 0.088 mole per liter of $Al_2(SO_4)_3$. In each of Examples 7 and 8, a total charge of 2.0 Faradays per mole was employed. In all other respects, the procedures of Examples 7 and 8 were identical to that of Example 1. The results are listed in Table VI.

TABLE VI

| Example No. | Electrolyte | Ethylene Glycol (g) | Glycolic Acid (g) | Glycerine (g) | C-4 Fragment (g) | C-5 Fragment (g) | % Polyol Converted | Power Usage KWhr/mole Polyol Converted |
|---|---|---|---|---|---|---|---|---|
| 7 | $NaBF_4$ | 2.69 | 0.20 | 1.70 | 0.79 | 0.00 | 50 | 0.93 |
| 8 | $Al_2(SO_4)_3$ | 1.51 | 0.86 | 1.59 | 0.24 | 0.00 | 52 | 1.30 |

These Examples illustrate that the selectivity provided by the process of the present invention is not dependent upon the particular electrolyte which is used in the electrolysis system. In each of the above Examples, as well as Examples 1 and 2, good selectivity to two- and three-carbon fragments was obtained using different electrolytes.

COMPARATIVE EXAMPLES 13–16

These Comparative Examples illustrate the criticality of the presence of manganese during electrolysis in the process of the present invention. These Comparative Examples demonstrate that the process is inoperative in the absence of manganese despite the use of various different electrolytes. Comparative Examples 13, 15, and 16 employed 0.176 moles per liter of electrolyte; Comparative Example 14 employed 0.088 moles per liter of electrolyte. Comparative Examples 13 and 16 employed a total charge of 2.2 Faradays per mole of polyol, while Comparative Examples 13 and 14 utilized 2.0 Faradays per mole. In each of Comparative Examples 13–16, no manganese was present during electrolysis, and 0.1 mole of sorbitol was employed. In all other respects, the procedures of Comparative Examples 13–16 were the same as that of Example 1. The results of these Comparative Examples are given in Table VII, which also includes the corresponding data for Comparative Example 1 ($Na_2SO_4$ electrolyte).

TABLE VII

| Comparative Example No. | Electrolyte | Ethylene Glycol (g) | Glycolic Acid (g) | Glycerine (g) | C-4 Fragment (g) | C-5 Fragment (g) | % Polyol Converted | Power Usage KWhr/mole Polyol Converted |
|---|---|---|---|---|---|---|---|---|
| 1 | $Na_2SO_4$ | 0.41 | 0.24 | 0.72 | 1.03 | 1.45 | 26 | 1.77 |
| 13 | $NaBF_4$ | 0.36 | 0.32 | 0.72 | 1.37 | 1.88 | 48 | 1.18 |
| 14 | $Al_2(SO_4)_3$ | 0.00 | 0.00 | 0.37 | 0.74 | 1.65 | 19 | 4.01 |
| 15 | $MgSO_4$ | 0.26 | 0.26 | 0.46 | 0.90 | 1.81 | 21 | 2.93 |
| 16 | $KH_2PO_4$ | 0.21 | 0.23 | 0.74 | 0.94 | 1.61 | 35 | 1.87 |

In each of the Comparative Examples described above, poor selectivity to two- and three-carbon fragments is observed, with relatively large amounts of four- and five-carbon fragments being collected. These undesirable results are not affected by changes in the electrolyte used in the process.

EXAMPLE 9

This Example illustrates the use of a carbon anode in place of the platinum anode used in Example 1. Sorbitol (0.1 mole) was employed as the polyol, the anode current density was 0.219 amps/cm$^2$, and the total electric charge was 2.0 Faradays per mole. In all other respects, the procedure of the present example was identical to that of Example 1. The results are given in Table 8.

TABLE VIII

| Anode Material | Ethylene Glycol (g) | Glycolic Acid (g) | Glycerine (g) | C-4 Fragment (g) | C-5 Fragment (g) | % Polyol Converted | Power Usage KWhr/mole Polyol Converted |
|---|---|---|---|---|---|---|---|
| graphite (C) | 1.98 | 0.15 | 2.77 | 0.38 | 0.0 | 53 | 1.02 |

This Example illustrates the effectiveness of a graphite anode in the process of the present invention. The desirable selectivity to two- and three-carbon fragments is obtained, as with the platinum anode employed in Example 1.

EXAMPLES 10 AND 11

These Examples illustrate the use of xylitol (0.1 mole) and meso-erythritol (0.1 mole) in the process of the present invention. The total charge utilized in Examples 10 and 11 was 2.1 Faradays per mole. In all other respects, the procedures of Examples 10 and 11 were identical to that of Example 1. The results are given in Table 9.

TABLE IX

| Example No. | Polyol | Ethylene Glycol (g) | Glycolic Acid (g) | Glycerine (g) | C-4 Fragment (g) | C-5 Fragment (g) | % Polyol Converted | Power Usage KWhr/mole Polyol Converted |
|---|---|---|---|---|---|---|---|---|
| 10 | xylitol | 1.47 | 0.23 | 1.52 | 0.16 | — | 35 | 1.13 |
| 11 | meso-erythritol | 0.80 | 0.11 | 0.35 | — | — | 30 | 1.13 |

Examples 10 and 11 demonstrate the same desirable selectivity to ethylene glycol and glycerine which is provided by the use of sorbitol and mannitol which was illustrated by Examples 1 and 2. Additionally, Example 11 demonstrates the selectivity of the present process for internal carbon-carbon bonds, thereby yielding predominantly ethylene glycol with a smaller quantity of glycerine.

EXAMPLES 12 AND 13 AND COMPARATIVE EXAMPLE 17

These runs illustrate the effect of total electrical charge on the process of the present invention. Each of these runs utilized 0.1 mole of sorbitol as the polyol. Example 12 utilized a total charge of 1.0 Faraday per mole, while Example 13 and Comparative Example 17 utilized a total charge of 4.0 Faradays per mole. Examples 12 and 13 were run in the presence of maganese, while Comparative Example 17 was run in the absence of manganese. In all other respects, these runs were conducted according to the procedure of Example 1. The results are given below in Table X.

TABLE X

| Example No. | Total Charge (Faradays/ Mole) | Promoter | Ethylene Glycol (g) | Glycolic Acid (g) | Glycerine (g) | C-4 Fragment (g) | C-5 Fragment (g) | % Polyol Converted | Power Usage KWhr/mole Polyol Converted |
|---|---|---|---|---|---|---|---|---|---|
| Example 12 | 1.00 | $Mn(OAc)_2$ | 0.91 | 0.0 | 1.98 | 0.98 | Trace | 26 | 0.86 |
| Example 13 | 4.00 | $Mn(OAc)_2$ | 1.76 | 1.02 | 2.52 | 0.42 | Trace | 75 | 1.06 |
| Comp. Ex. 17 | 4.00 | None | 0.00 | 1.29 | 0.23 | 0.00 | 0.00 | 36 | 2.27 |

Examples 12 and 13 demonstrate that the desired selectivity to ethylene glycol and glycerine is obtained regardless of the total charge employed. However, the percent polyol conversion is much greater at the higher total charge as would be expected. Comparative Example 17 illustrates that the desired selectivity is not obtained in the absence of manganese despite the elevated level of total charge which was utilized.

The invention has been described in detail with particular reference to preferred embodiments thereof, but it will be understood that variations and modifications can be effected within the spirit and scope of the invention.

I claim:

1. A process for the production of ethylene glycol and glycerine which comprises (a) electrolyzing a carbohydrate-derived polyol in the presence of an electrolysis medium comprising manganese, and (b) reducing the intermediate products to ethylene glycol and glycerine.

2. The process of claim 1 wherein said carbohydrate-derived polyol is selected from among sorbitol, mannitol, D-(−)-fructose, xylitol, erythritol, and mixtures thereof.

3. The process of claim 1 wherein said manganese is present in an amount of about 50 to 500 ppm.

4. The process of claim 1 wherein the pH of the electrolysis medium is about 1.5 to 9.

5. A process for the production of ethylene glycol and glycerine which comprises (a) electrolyzing a carbohydrate-derived polyol selected from among sorbitol, mannitol, D-(−)-frutose, xylitol, erythritol, and mixtures thereof in the presence of an electrolysis medium comprising about 50 to 500 ppm manganese, and (b) reducing the intermediate products to ethylene glycol and glycerine.

6. The process of claim 5 wherein the pH of the electrolysis medium is about 1.5 to 9.

* * * * *